US006082592A

United States Patent [19]

McKenna et al.

[11] Patent Number: 6,082,592

[45] Date of Patent: Jul. 4, 2000

[54] CARRIER FOR A PUMP TYPE ATOMISER

[75] Inventors: Maurice McKenna, Bettystown; Aidan Clear, Dublin; Angus McGlynn, Limerick, all of Ireland

[73] Assignee: The Enterprises Limited, Bettystown, Ireland

[21] Appl. No.: 08/975,681

[22] Filed: Nov. 21, 1997

Related U.S. Application Data

[62] Division of application No. 08/433,463, filed as application No. PCT/IE93/00054, Nov. 11, 1993, Pat. No. 5,727,715.

[30] Foreign Application Priority Data

Nov. 11, 1992 [IE] Ireland ..... 92 2807

[51] Int. Cl.[7] ..... B67D 5/64

[52] U.S. Cl. ..... 222/162; 222/180

[58] Field of Search ..... 222/162, 181.1, 222/181.2, 185.1, 180

[56] References Cited

U.S. PATENT DOCUMENTS

| | | | |
|---|---|---|---|
| 4,694,976 | 9/1987 | Schuetz | 222/189.09 X |
| 4,771,769 | 9/1988 | Hegemann et al. | 222/162 X |
| 4,917,271 | 4/1990 | Kanner et al. . | |
| 4,930,667 | 6/1990 | Holzner, Sr. | 222/189.09 |
| 5,074,440 | 12/1991 | Clements et al. . | |
| 5,082,149 | 1/1992 | Cross . | |
| 5,154,325 | 10/1992 | Ryder et al. . | |
| 5,598,954 | 2/1997 | Salzano | 222/162 |

FOREIGN PATENT DOCUMENTS

| | | | |
|---|---|---|---|
| 0 189 549 | 11/1985 | European Pat. Off. . | |
| 0 487 412 | 11/1991 | European Pat. Off. . | |
| 3-240655 | 10/1991 | Japan | 222/189.09 |

*Primary Examiner*—Gregory L. Huson

*Attorney, Agent, or Firm*—Jacobson, Price, Holman & Stern PLLC

[57] ABSTRACT

An atomiser has a container for pure water. A pump is mounted on the container for dispensing water form the container as an atomised spray. The pump has an air vent passage to allow air into the container as water is discharged. A filter is mounted across the vent passage to purify air drawn into the container when water is discharged.

1 Claim, 18 Drawing Sheets

CARRIER FOR A PUMP TYPE ATOMISER

This is a divisional of application Ser. No. 08/433,463, filed Jul. 7, 1995, now U.S. Pat. No. 5,727,715, which is a 371 filing of PCT/1E93/00054 filed Nov. 11, 1993.

This invention relates to an atomiser and in particular an atomiser for producing a fine spray mist of water. It is known to provide a spring water atomiser comprising a pressurised container of water which can be discharged in a fine spray via gas driven aerosol. Until recently a CFC gas was used for propulsion but now more environmentally acceptable gases are used in the aerosol. A pressurised aerosol is not, however, suitable for all ages and for all environments.

The present invention is directed towards the provision of a liquid spray device which overcomes this problem.

According to the invention there is provided an atomiser comprising a container for liquid, means for dispensing liquid from the container as an atomised spray, a vent passage communicating between an interior and exterior of the container, and means to purify air drawn into the container through the vent passage when liquid is discharged from the container.

In a particularly preferred embodiment of the invention the means to purify air is a filter mounted across the vent passage. Thus, advantageously as vent air is drawn into the container, it is purified to prevent contamination of the liquid within the container.

In another embodiment the filter has openings for through passage of air, said openings being sized to block harmful bacteria. Typically the openings are of a size no greater than 0.2 microns. Thus, advantageously the filter will trap any harmful bacteria in the vent air drawn into the container. At the same time there is sufficient air movement through the filter so that the spray remains effective and fine. The filter should preferably be of a material which is resistant to the liquid in the container so it will not disintegrate or lose its effectiveness after contact with the liquid in the container.

In one embodiment the filter is mounted at an inner end of the vent passage within the container. Alternatively, the filter may be mounted at an outer end of the vent passage.

In a particularly preferred embodiment the filter is supported on a holder mounted across the vent passage. Preferably the holder has a number of through holes across which the filter is supported.

In a further embodiment the dispensing means is a pump. Ideally the pump has a housing through which the vent passage passes, the holder being mounted on the pump housing across the vent passage.

In a particularly preferred embodiment the pump has an inlet for communication with an interior of the container and an outlet with a spray nozzle for discharging liquid from the container in an atomised spray, a spring-loaded plunger slidably mounted within the housing and projecting outwardly therefrom, operable to deliver liquid between the inlet and the outlet, a mounting flange projecting outwardly of the housing for engagement with a periphery of an opening in the container to mount the pump on the container, the filter holder being mounted between the housing and the flange across the vent passage.

In another embodiment the filter holder has a tubular body which is a sleeved fit on an exterior of the housing beneath the flange, the body having a flanged upper end with a number of spaced-apart vent holes across which the filter is mounted, an upstanding peripheral rim on the flanged end engaging the pump mounting flange.

In a further embodiment the filter holder has a ring-shaped body with a central through hole for engagement around the pump housing, an air-tight seal being provided between the pump housing and the body, the filter being mounted on the body across a number of vent holes passing through the body, an upper face of the body engaging an underside of the pump mounting flange.

In another embodiment the housing and the flange are of plastics material, the holder being ultrasonically welded to the housing and the flange. This greatly facilitates manufacture enabling the holder to be quickly mounted on the housing in an efficient and economic manner.

In a further embodiment the filter holder has a tubular body engagable with an upper end of the pump housing, an upper end wall of the body having a central through hole for through passage of the pump plunger, an air-tight seal being provided between the end wall and the plunger, the end wall having a number of vent holes across which the filter is supported.

In another embodiment the filter holder has a tubular body which loosely engages around an upper end of the pump housing, an upper end wall of the body having a central through hole for through passage of the pump plunger, an air-tight seal being provided between the end wall and the plunger, a flange extending outwardly of the body to engage the pump mounting flange, the filter mounted on said flange across vent holes in the flange.

In another embodiment the vent passage is formed by a vent pipe passing through the pump housing, the filter being mounted at an outer end of the vent pipe.

In another aspect the invention provides an atomiser as previously described, said atomiser containing pure water for discharge as an atomised spray.

In a further aspect of the invention there is provided a filter assembly for an atomiser of the type previously described, the filter assembly comprising a filter supported on a holder having means for mounting the holder on the atomiser across the air vent passage.

In a still further aspect of the invention there is provided an atomiser system comprising an atomiser of the type previously described in combination with an associated carrier; the carrier comprising means for reception of the atomiser and means for mounting the support on a support surface.

In another embodiment the carrier has means to demountably secure the atomiser thereon.

In another embodiment the carrier has a housing for reception of the atomiser with a discharge opening through which the atomised spray is directed, and actuating means for operating the atomiser when it is mounted on the carrier.

In a particularly preferred embodiment slots are provided in a rear wall of the housing for reception of mounting screws to demountably secure the carrier on an upright support surface. Typically the slots have an inverted keyhole shape.

The invention will be more clearly understood by the following description of some embodiments thereof, given by way of example only, with reference to the accompanying drawings, in which.

Figure 11:
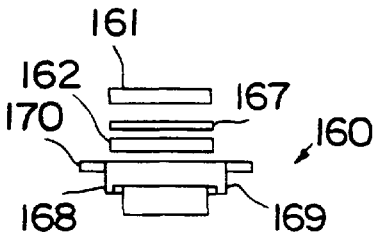
FIG. 11 is an exploded, partially sectional elevational view of another filter.
Figure 12A:
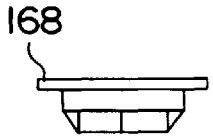
Figure 12B:
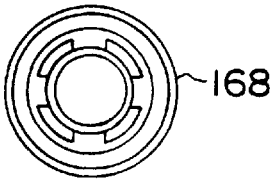

FIG. 12*a* is an elevational view portion of the filter of FIG. 11;

FIG. 12*b* is an underneath plan view of the filter portion of FIG. 12*a:*

Figure 12C:
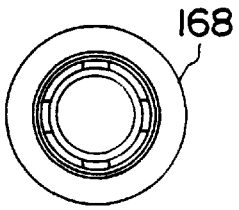

FIG. 12*c* is a top plan view of the filter portion of FIG. 12*a;*

Figure 13:
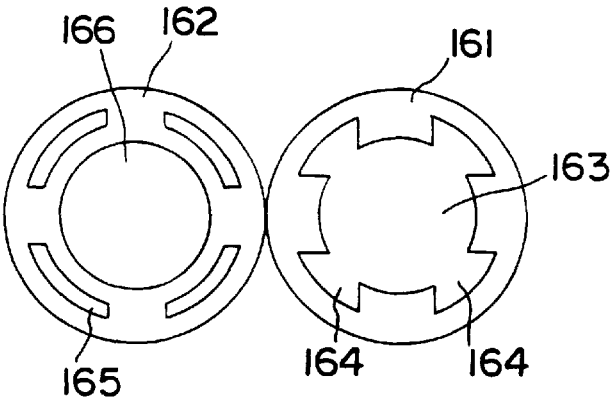
Figure 14:
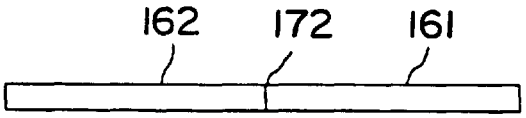
Figure 15:
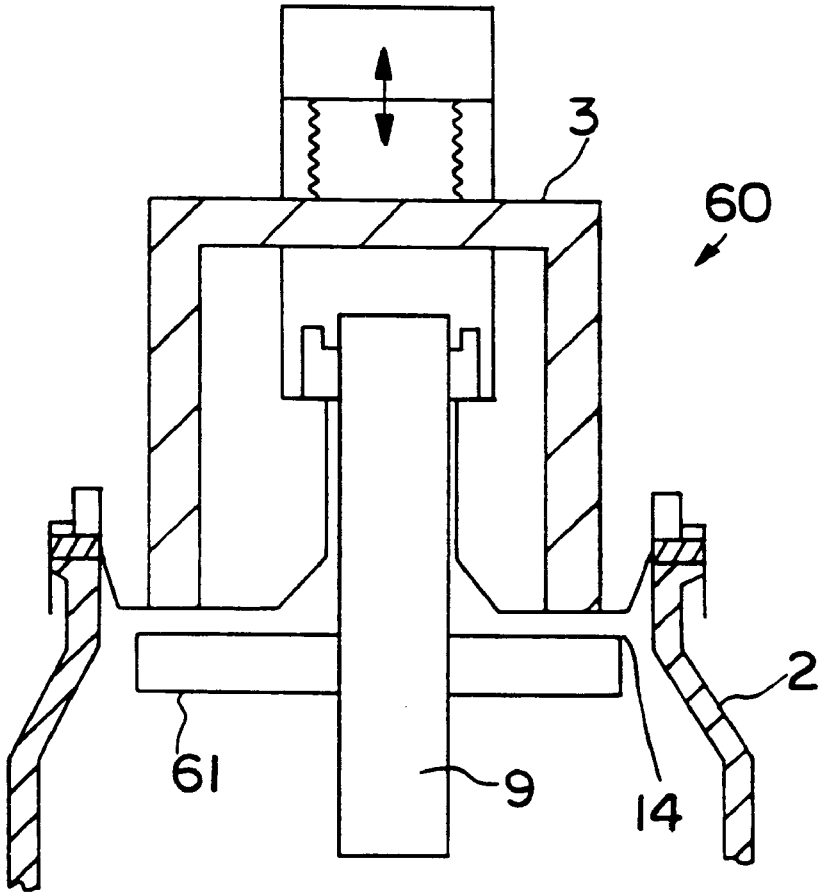
Figure 16:
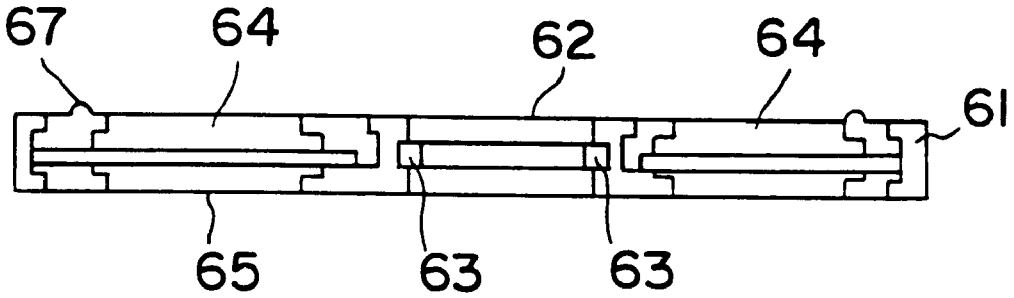
Figure 17:
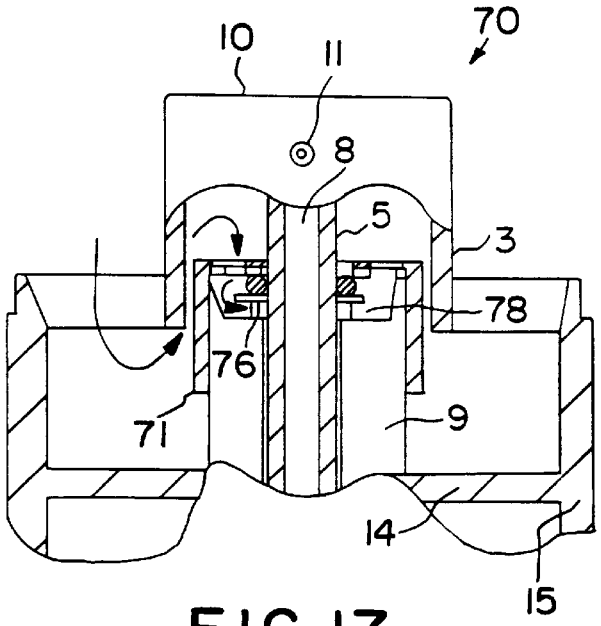
Figure 18:
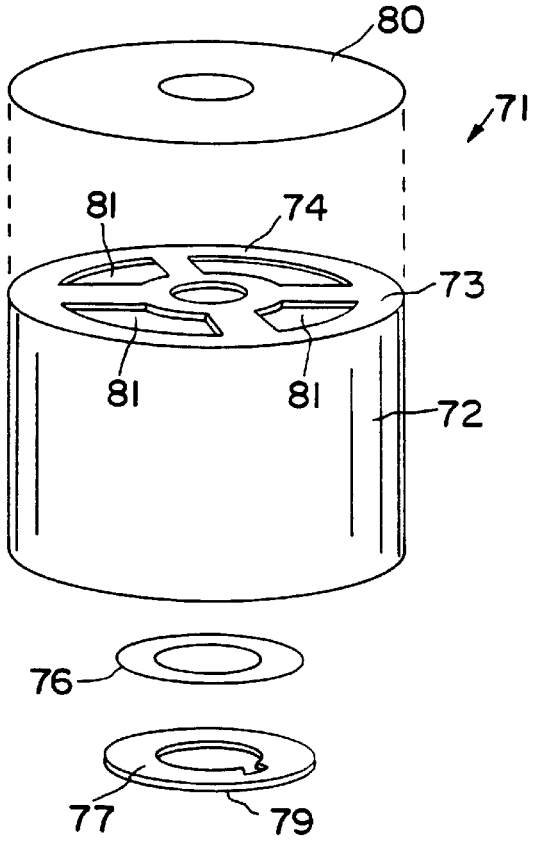
Figure 19:
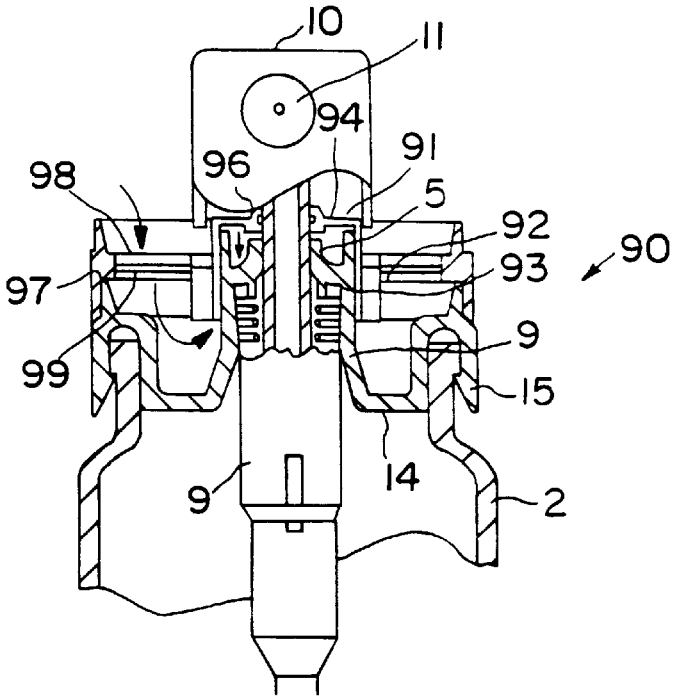
Figure 20:
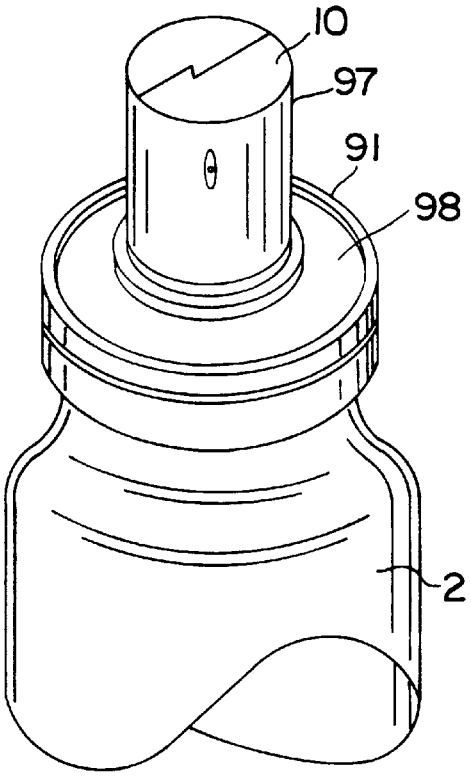
Figure 21:
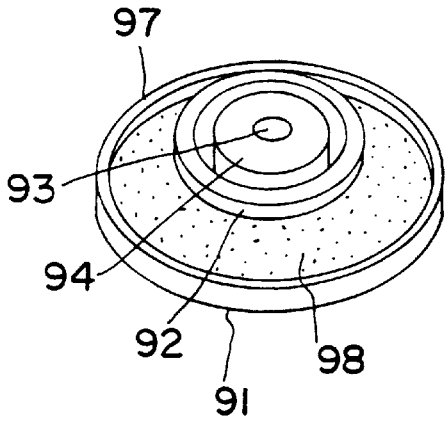
Figure 22:
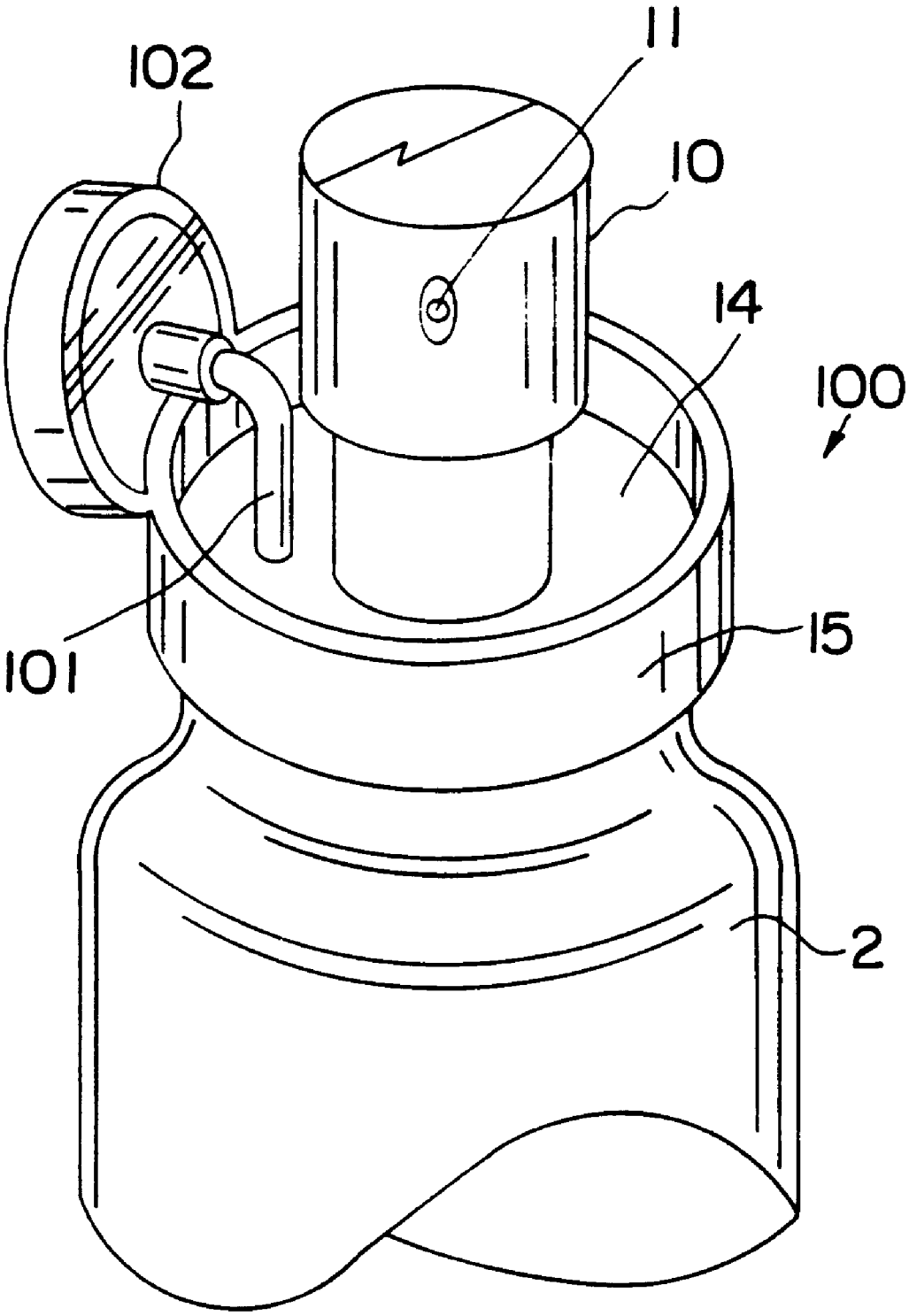
Figure 23:
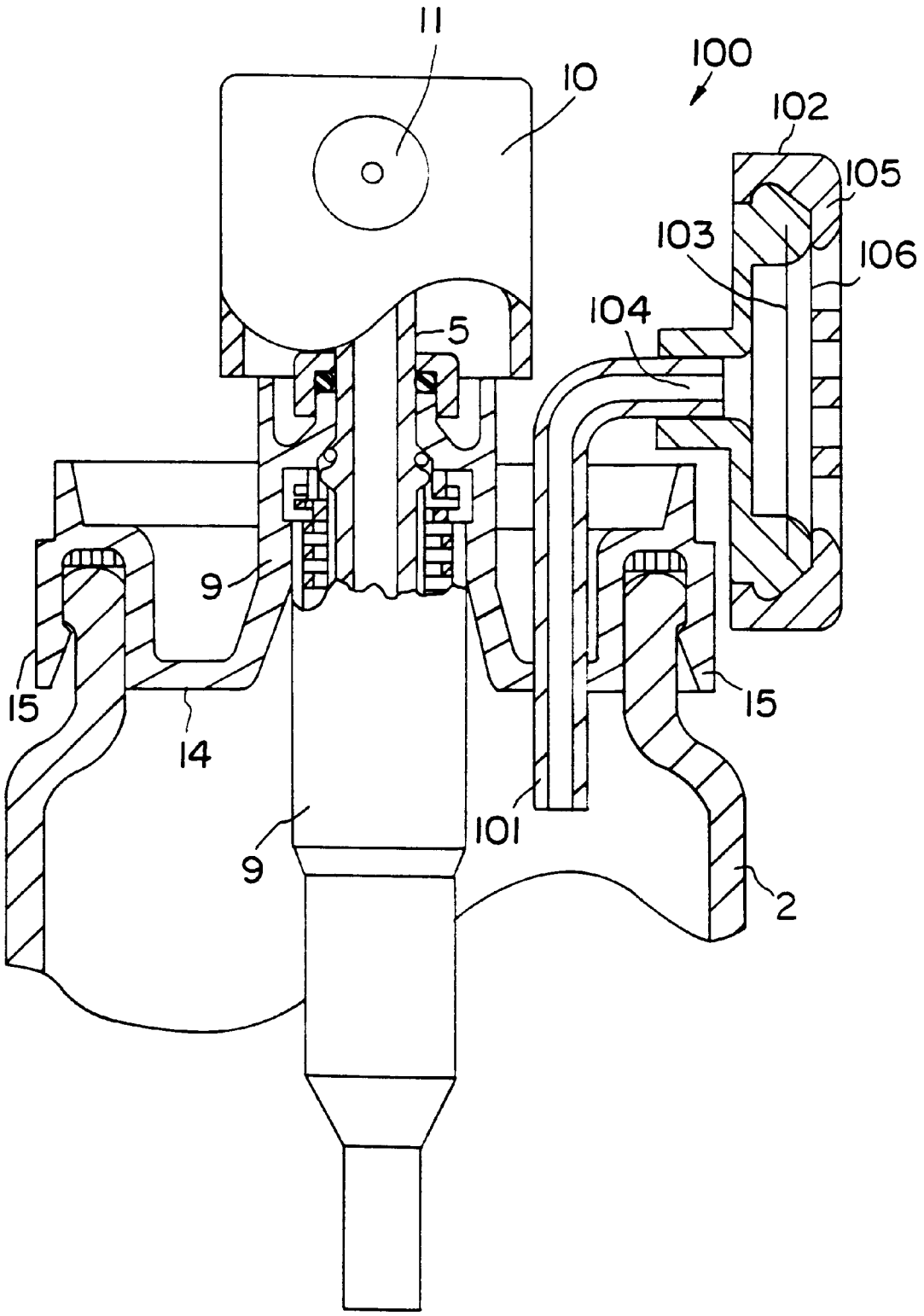
Figure 24:
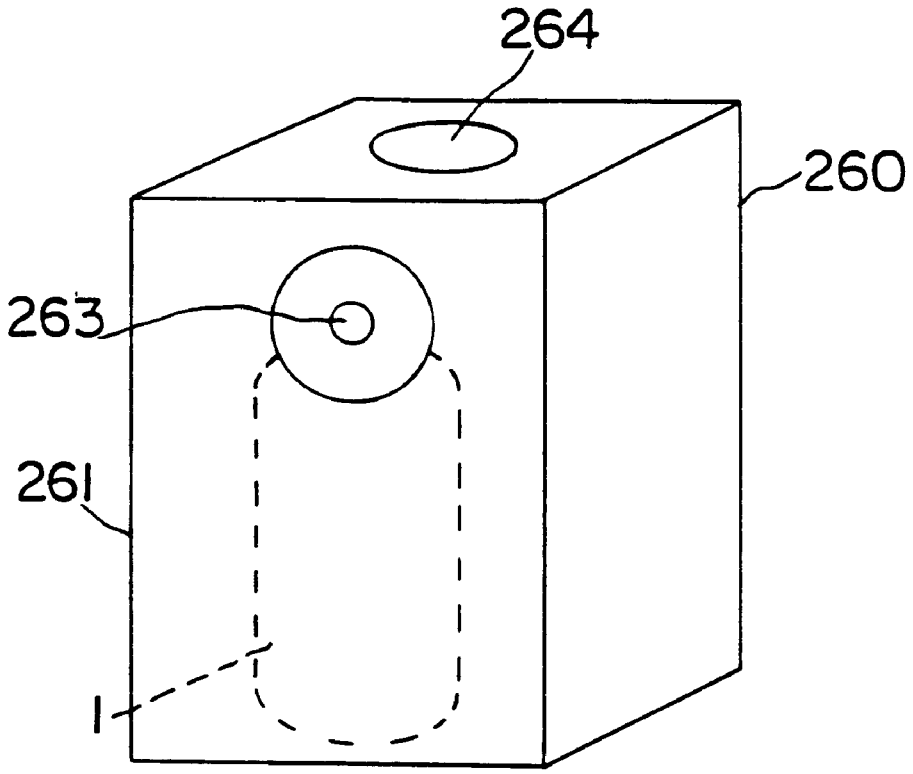
Figure 25:
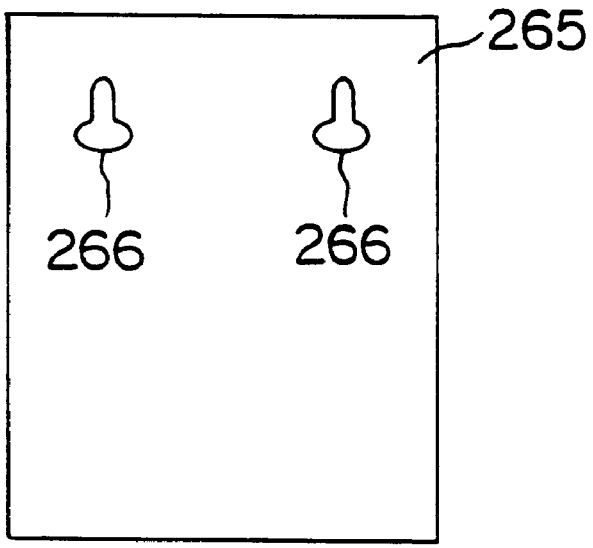
Figure 26:
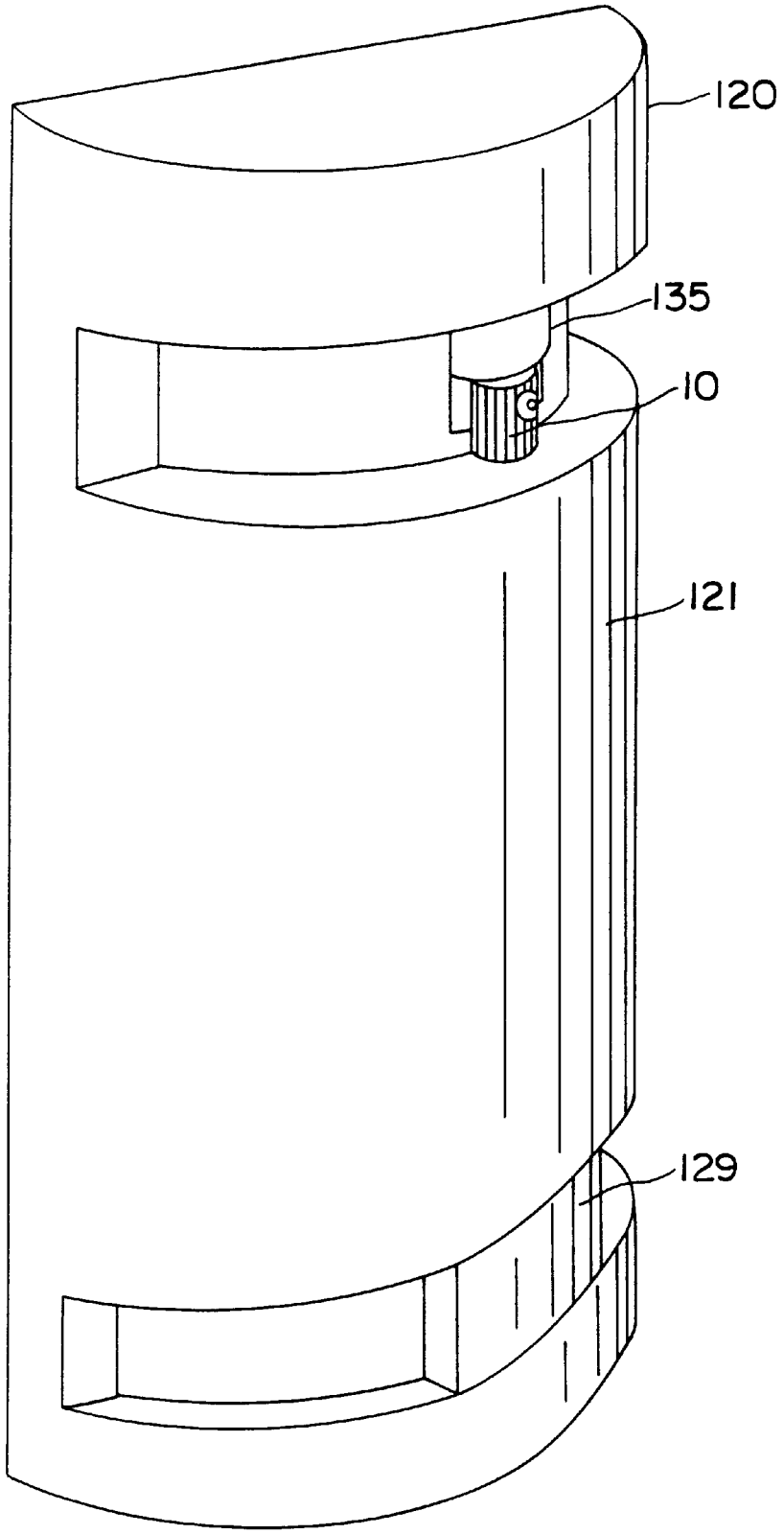
Figure 28:
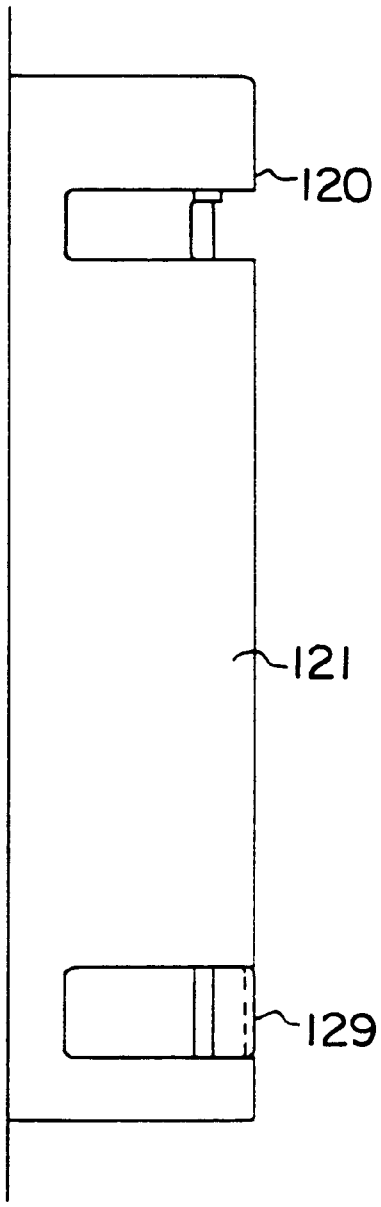
Figure 27:
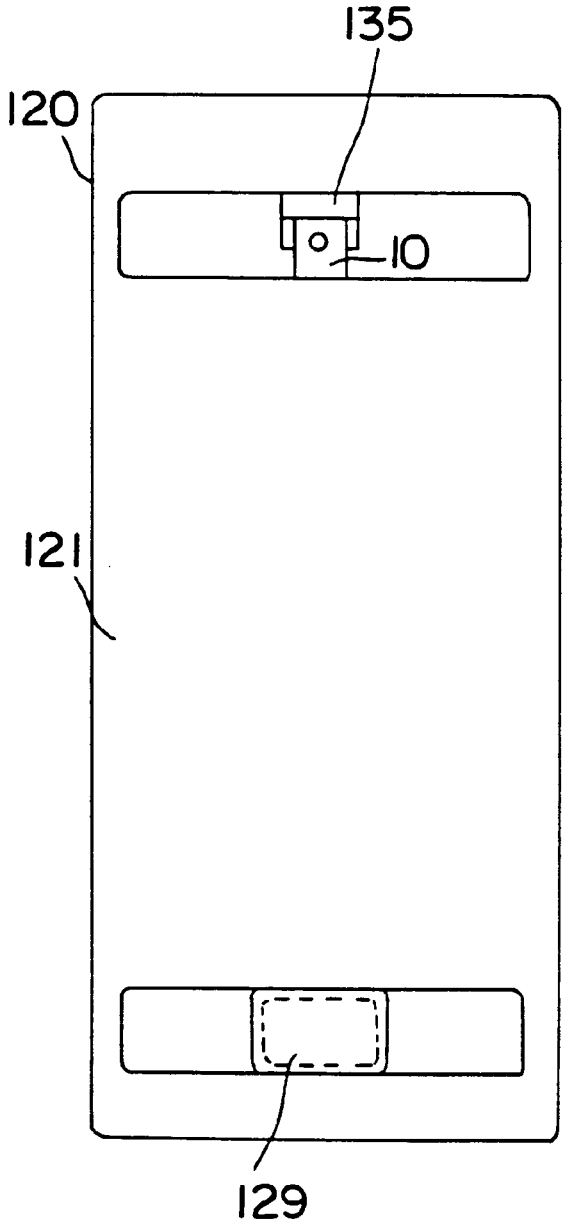
Figure 29:
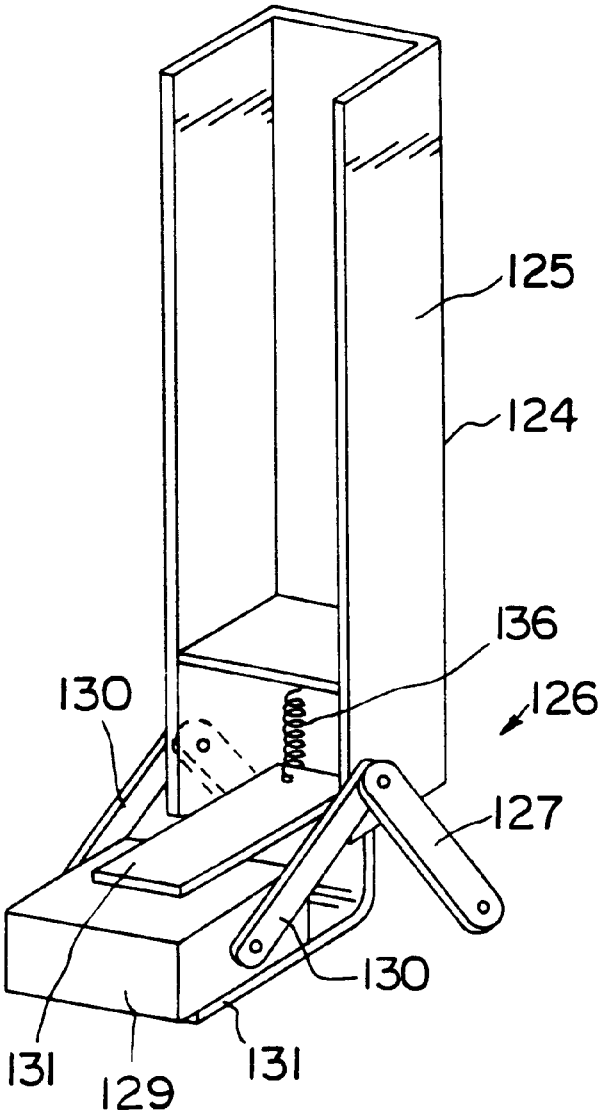
Figure 30:
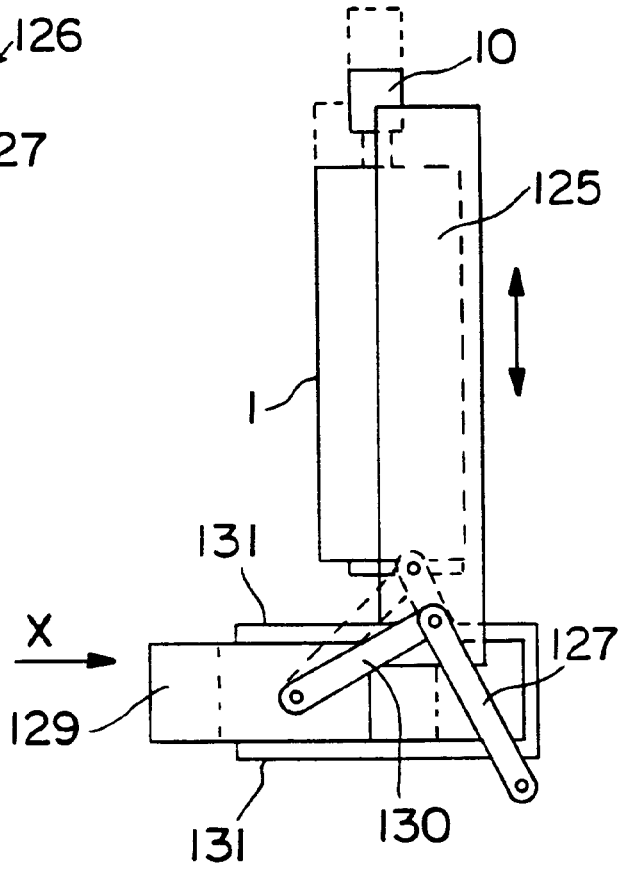
Figure 31:
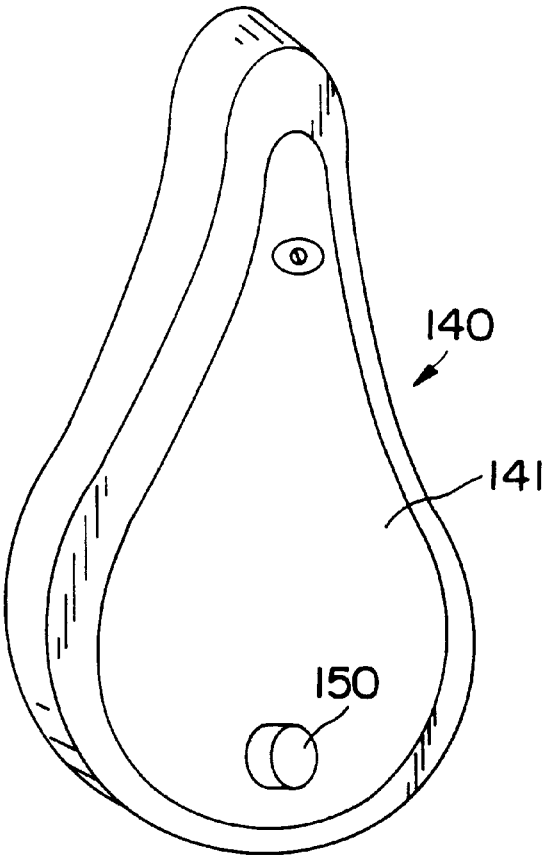
Figure 34:
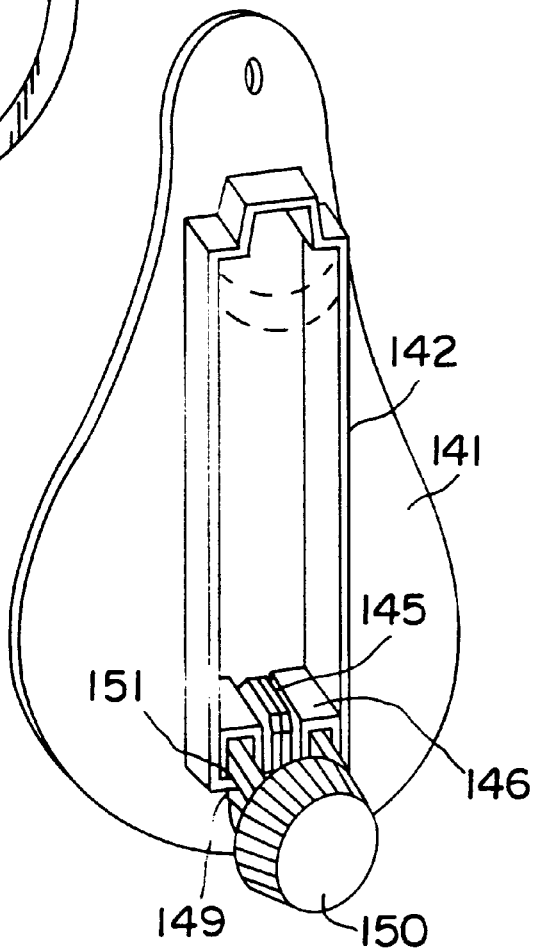
Figure 32:
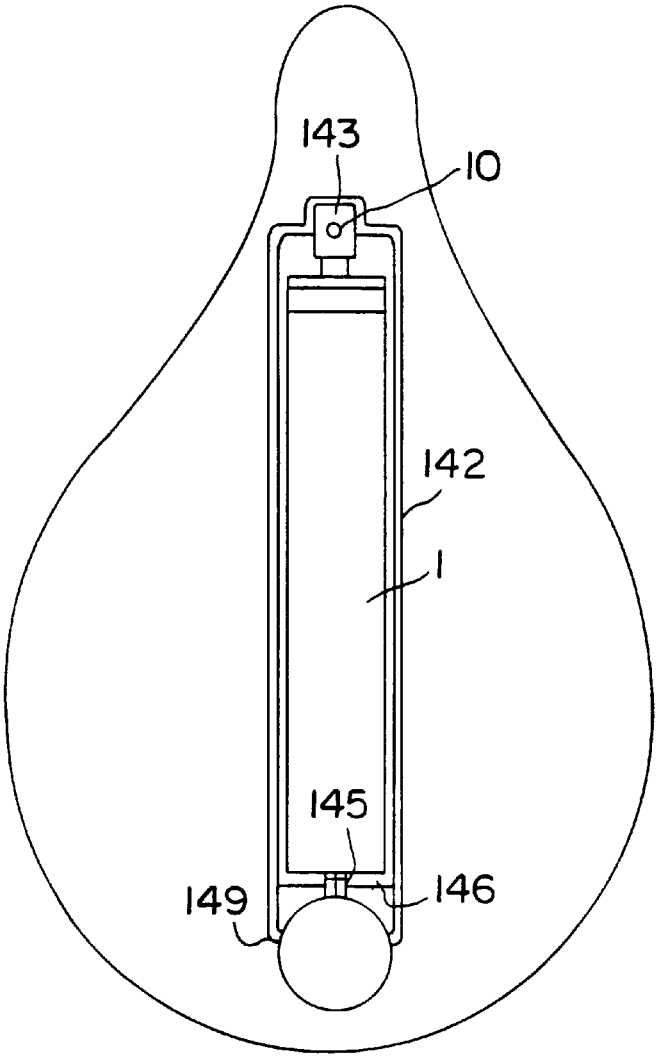
Figure 33:
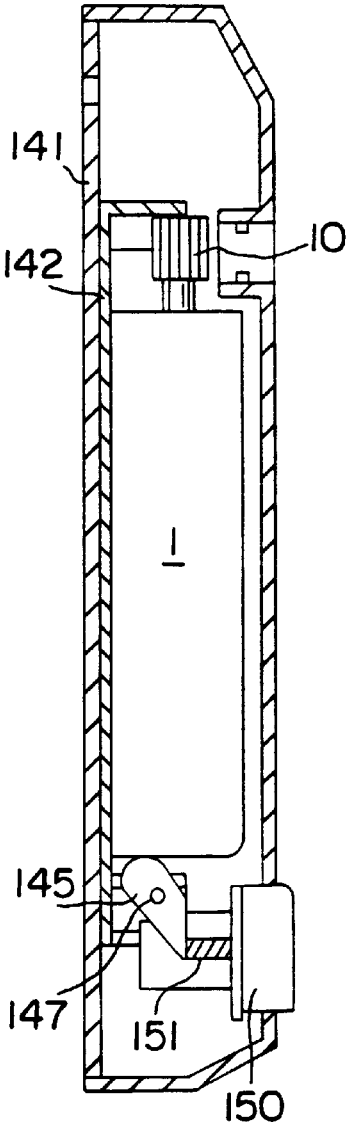
Figure 35:
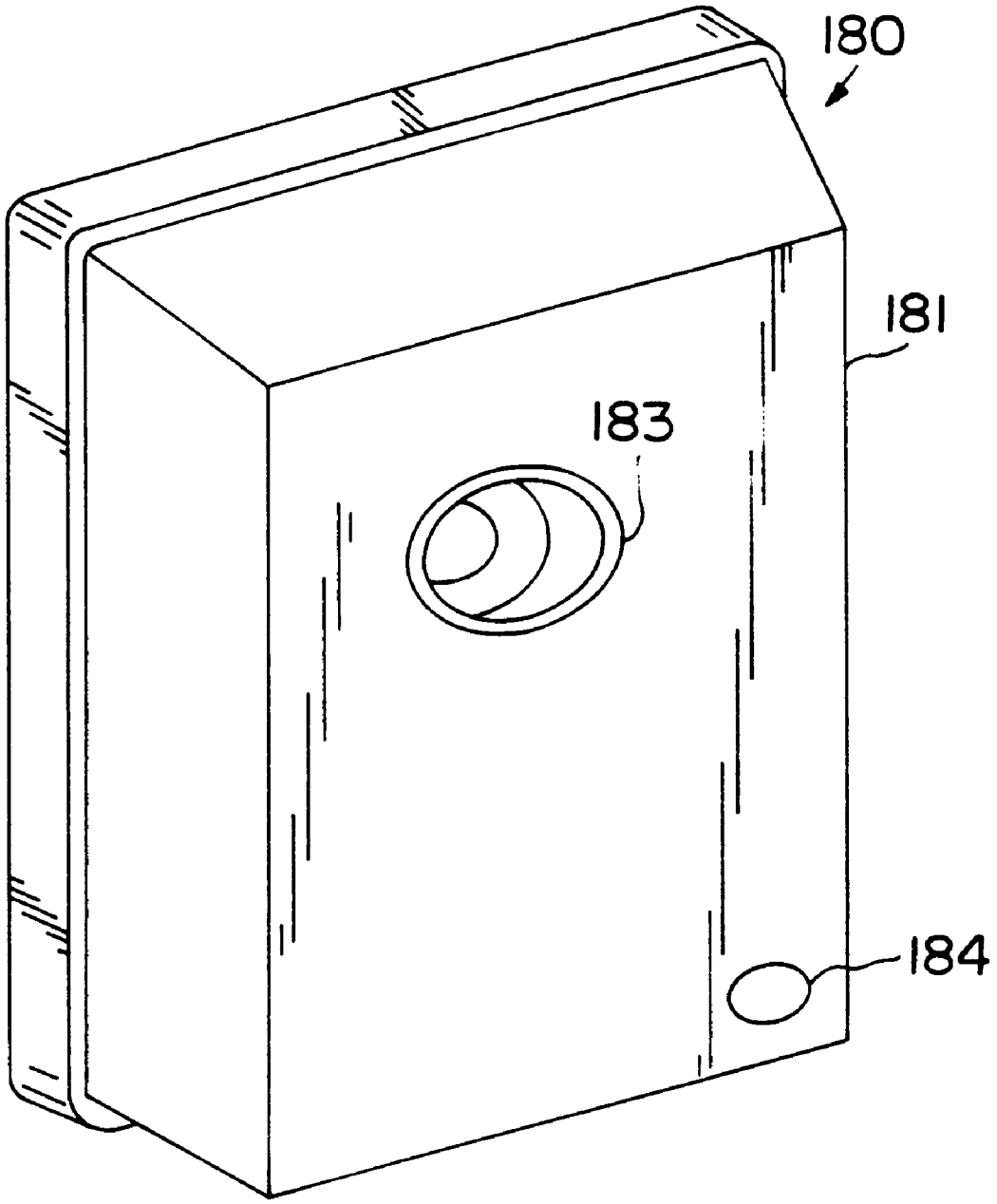

FIG. 13 is a plan view of portion of the filter of FIG. 11;

FIG. 14 is an elevational view of the filter portion of FIG. 13;

FIG. 15 is a detail diagrammatic sectional elevational view of another atomiser;

FIG. 16 is a sectional elevational view of a filter and filter holder forming portion of the atomiser of FIG. 15;

FIG. 17 is a detail sectional elevational view showing a pump portion of another atomiser;

FIG. 18 is an exploded view of a filter assembly incorporated in the pump of FIG. 17;

FIG. 19 is a detail sectional view similar to FIG. 17 of a pump portion of another atomiser incorporating a different filter assembly;

FIG. 20 is a perspective view of the pump portion shown in FIG. 19;

FIG. 21 is a perspective view of a filter assembly incorporated in the atomiser of FIG. 19;

FIG. 22 is a perspective view of portion of another atomiser;

FIG. 23 is a detail sectional elevational view of the atomiser portion shown in FIG. 22;

FIG. 24 is a perspective view of a carrier for mounting the atomiser on a support surface;

FIG. 25 is a rear elevational view of the carrier;

FIG. 26 is a perspective view of another carrier for the atomiser;

FIG. 27 is a front elevational view of the carrier of FIG. 26;

FIG. 28 is a side elevational view of the carrier of FIG. 26;

FIG. 29 is a detail perspective view showing portion of the carrier of FIG. 26;

FIG. 30 is a side elevational view of the carrier portion shown in FIG. 29;

FIG. 31 is a perspective view of another carrier for the atomiser;

FIG. 32 is a front elevational view of the carrier with a front cover of the carrier removed;

FIG. 33 is a side sectional elevational view of the carrier portion of FIG. 32;

FIG. 34 is a perspective view of the carrier portion of FIG. 32;

FIG. 35 is a perspective view of another carrier; and

Figure 36:
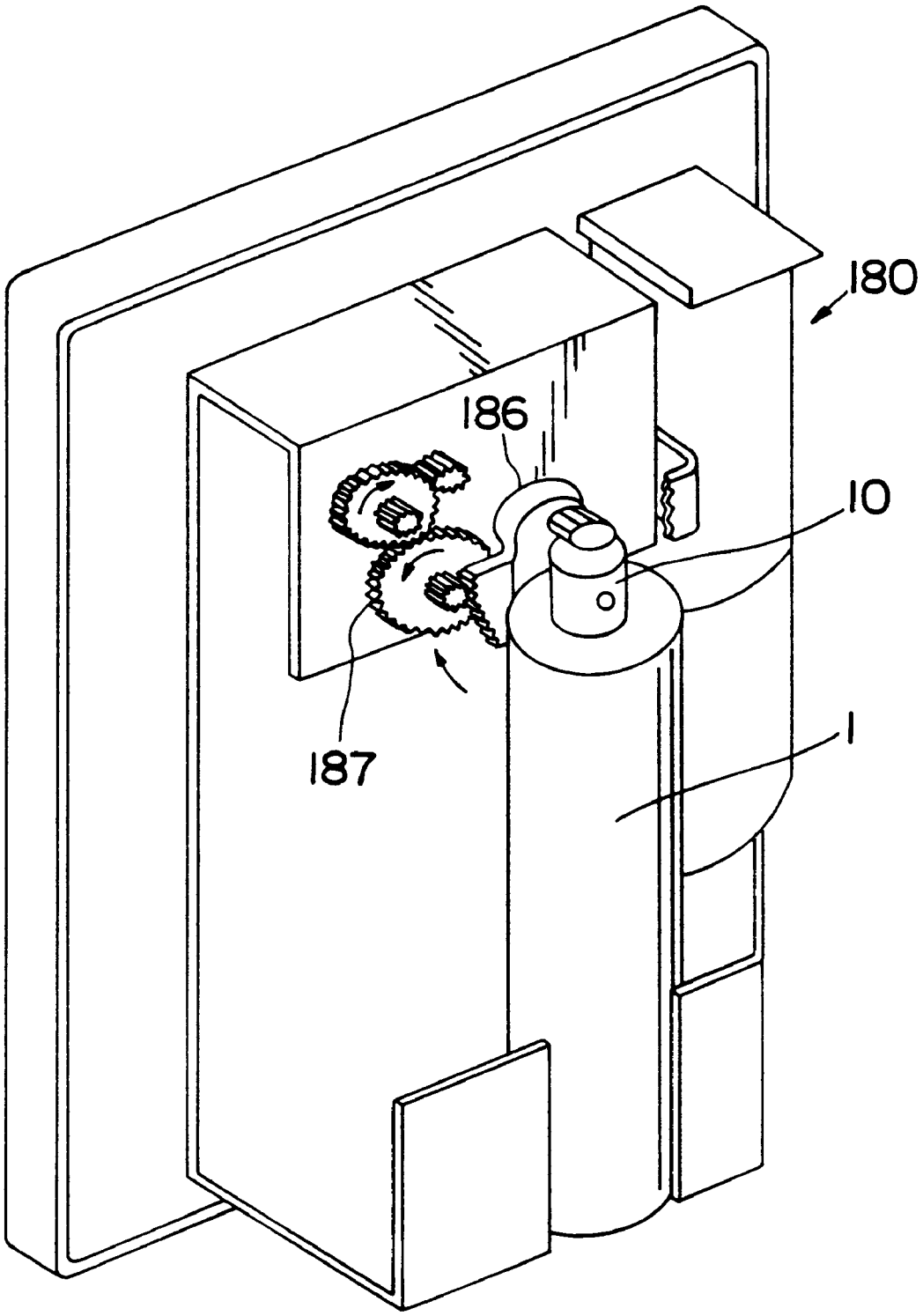

FIG. 36 is a perspective view of the carrier of FIG. 35 with a front cover removed.

Referring to the drawings, and initially to FIGS. 1 to 5 thereof, there is illustrated a water atomiser according to the invention indicated generally by the reference numeral 1. The water atomiser 1 has a clear plastics container 2. A pump 3 is mounted on the container 2 for dispensing water from the container 2 as an atomised spray. The pump 3 incorporates an air vent passage communicating between an interior and an exterior of the container 2 to allow air into the container 2 as water is discharged therefrom. Mounted on the pump 3 across the vent passage is a filter 4 to purify air drawn into the container 2 when water is discharged from the container 2.

The pump 3 has a cylindrical housing 9 of plastics material. A spring-loaded plunger 5 is slidably mounted within the housing 9 and projects outwardly from an upper end of the housing 9. A pump inlet 6 at a lower end of the housing 4 has a feed tube 7 attached thereto and extending downwardly to a bottom of the container 2. A fluid passage through the plunger 5 leads to a pump outlet 8. A nozzle 10 with a discharge opening 11 is mounted at the pump outlet 8 to produce a fine atomised water mist when the pump 3 is operated.

A mounting flange 14 projects outwardly of the housing 9. An outer edge 15 of the flange 14 is a snap-fit into engagement with a periphery of an opening at a top of the container 2 for mounting the pump 3 on the container 2. A vent passage passes through the housing 9 to vent air into the container 2 as the pump 3 is operated. The filter 4 is mounted between the housing 9 and the flange 14 across the vent passage to filter air vented into the container 2.

Figure 1:
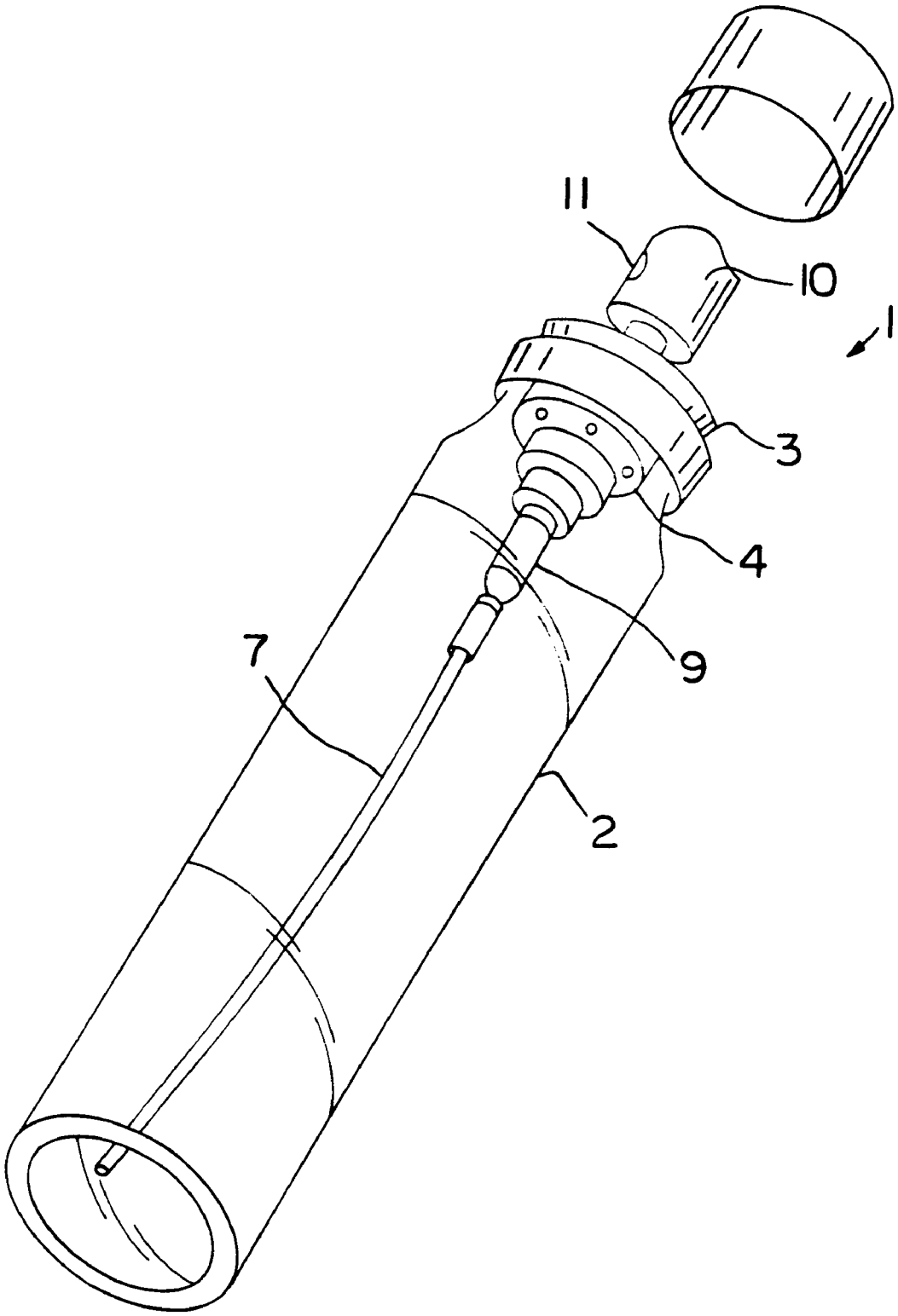
FIG. 1 is a perspective view of an atomiser according to the invention.
Figure 2:
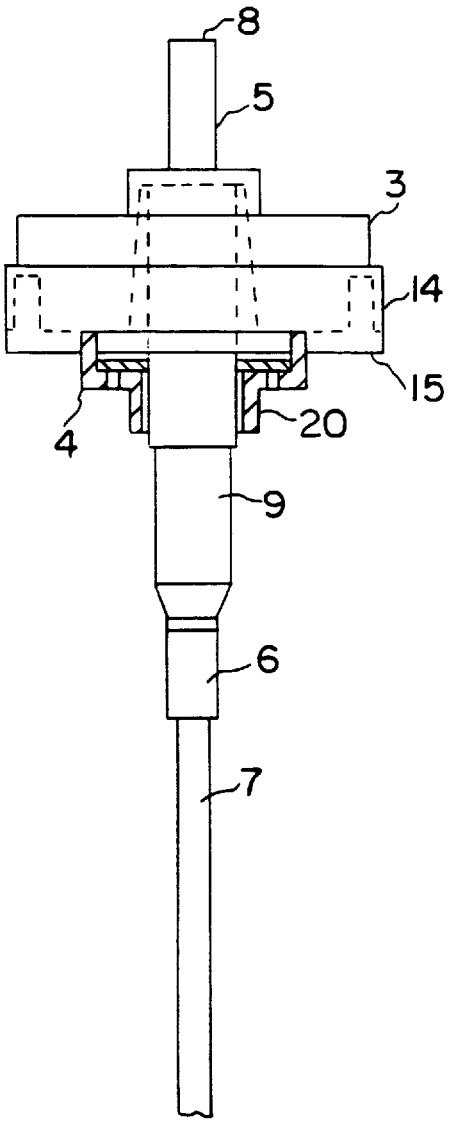
FIG. 2 is an elevational, partially sectioned view of a pump portion of the atomiser.
Figure 4:
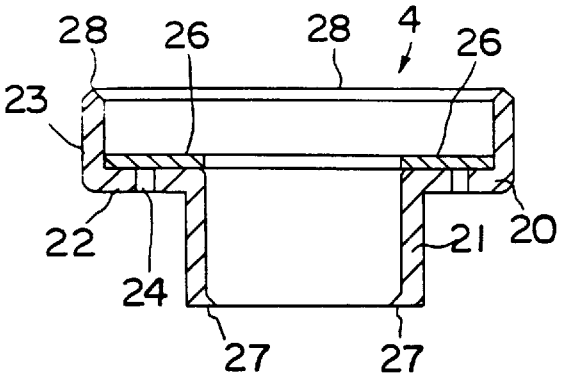
FIG. 4 is a sectional elevational view taken along the line IV—IV of FIG. 3.
Figure 5:
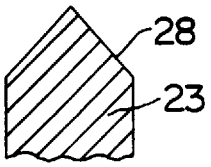
FIG. 5 is a detail sectional view of portion of the filter shown in FIG. 4.
Figure 3:
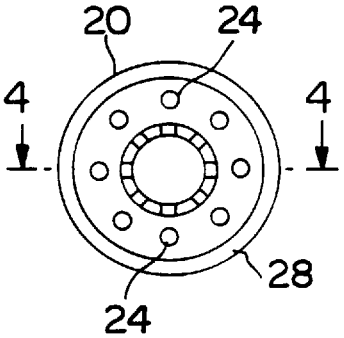
FIG. 3 is a plan view of a filter portion of the atomiser.

Referring now in particular to FIGS. 3 to 5 the filter 4 is shown in more detail. The filter 4 comprises a plastics holder 20 having a tubular body 21 which is a sleeved fit on an exterior of the housing 9. An annular flange 22 is provided at an upper end of the body 21 and has an upstanding peripheral rim 23. A number of spaced-apart through holes 24 forming air vent holes are provided around the flange 22. These through holes 24 are covered by an annular membrane filter 26 having a pore size of 0.2 microns. It will be noted that an inwardly directed lip 27 is provided at a lower end of the body 21 to form an energy director for ultrasonic welding of the holder 20 to an exterior of the pump housing 9. Similarly an upper end of the rim 23 is provided with a pointed tip 28 forming an energy director for ultrasonic welding of the rim 23 to an underside of the flange 14 of the pump 3.

In use, the container 2 is filled with pure water. The pump 3 can be operated by depressing and releasing the plunger 5 as desired to discharge water in a fine atomised spray. Ambient air is drawn in through the vent passage as the pump 3 is operated and is filtered as it passes through the membrane filter 26 and into the container 2. The filter pore size is such that it forms a barrier to any bacteria thus ensuring the purity of the water within the container 2 is maintained during use. There is, however, sufficient air movement through the filter so that the spray remains effective and fine. A typical Gurley air flow for the filter is rated at 27.4 seconds/100 cc. The membrane is hydrophobic with a water breakthrough at 32 psi.

The invention provides a water atomiser which is mechanically operated for delivery of a finely atomised mist of pure water. The water is discharged as an aerated spray which gives a fine distribution of water mist. Advantageously vent air drawn into the container during use is filtered to prevent contamination of the water in the container. The filter construction and materials are chosen such that the filter repels water for good filtration without unduly restricting vent air flow through the filter which would adversely affect spray formation.

A chemical preservative could be added to the water in the container to neutralise any bacteria, spores or the like which might enter the bottle from a contaminated ambient air supply. However, this would detract from the purity of the water and would thus make it less attractive or in some cases unacceptable to many people. By use of mechanical filtration advantageously the purity of the water is maintained to provide a natural product which is safe on all skins, including a young child's skin, without the risk of allergies for example which might arise with the use of a chemical preservative.

Figure 6:
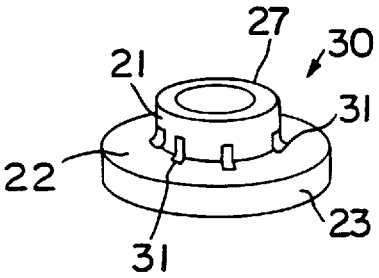
FIG. 6 is a perspective view of an alternative type of filter for use with the atomiser.
Figure 7:
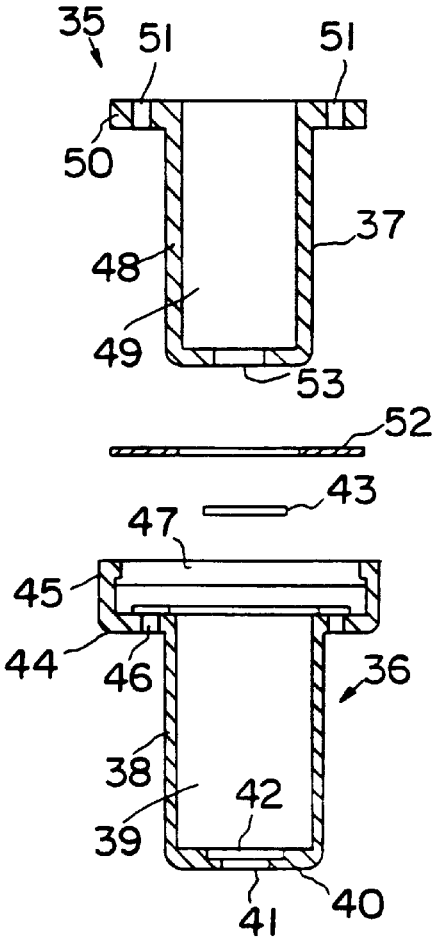
FIG. 7 is an exploded elevational view of another filter assembly for the atomiser.
Figure 8:
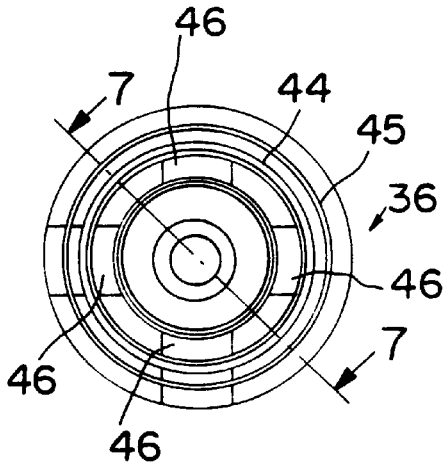
FIG. 8 is a plan view of portion of the filter of FIG. 7.
Figure 9:
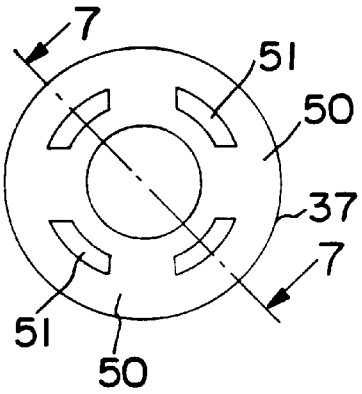
FIG. 9 is a plan view of another portion of the filter of FIG. 7.

Referring now to FIG. 6 there is illustrated another filter holder 30. This is similar to the holder described previously with reference to FIGS. 3 to 5 and like parts are assigned the same reference numerals. In this case through holes 31 for through passage of air are provided where the body 21 meets the flange 22.

Figure 10:
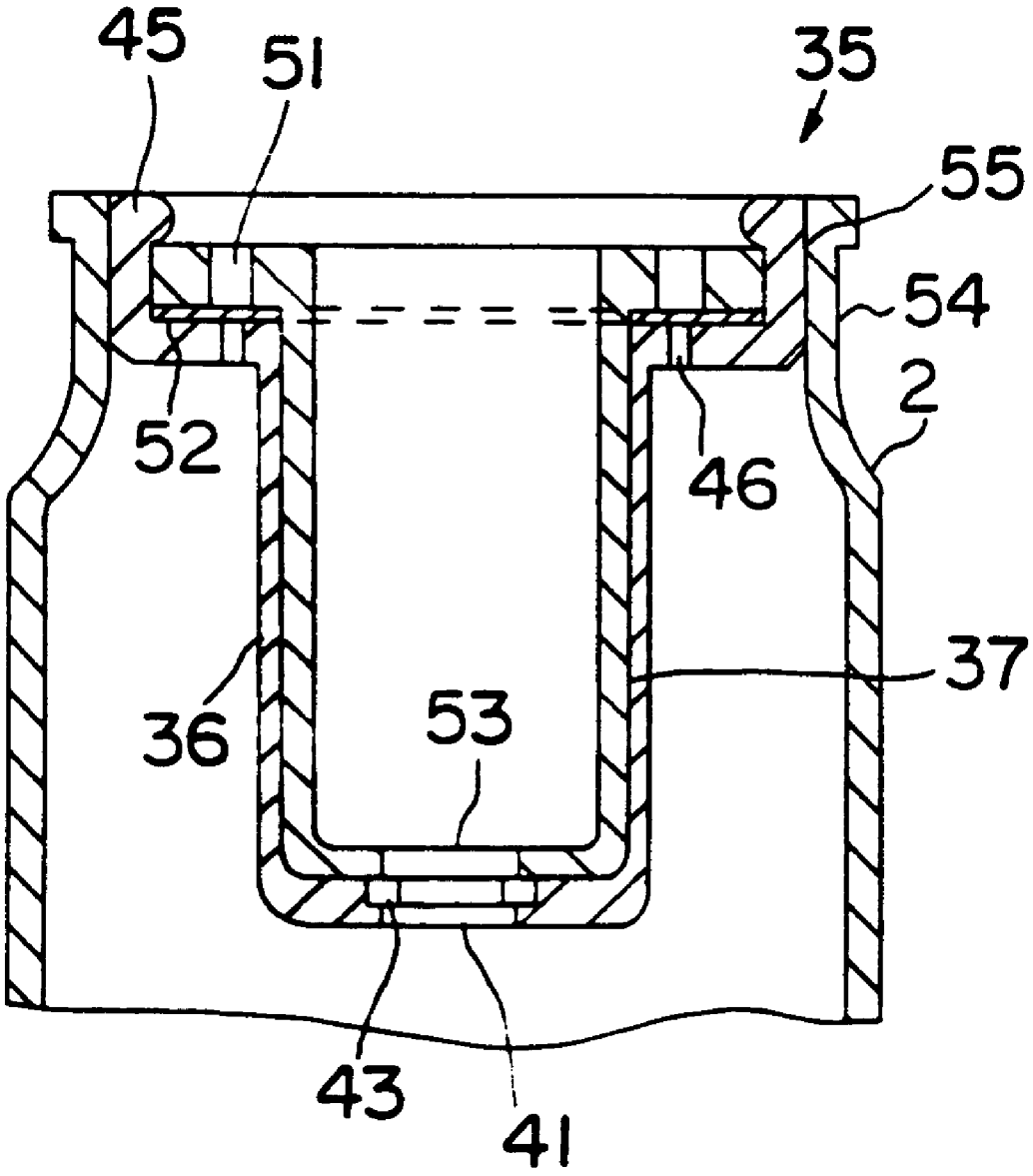
FIG. 10 is a sectional elevational view of the filter of FIG. 7 shown mounted on an atomiser bottle.

Referring now to FIGS. 7 to 10, an alternative filter assembly for the atomiser is shown and indicated generally by the reference numeral 35. The filter assembly 35 comprises an outer housing 36 and a complementary inner housing 37 engagable within the outer housing 36. The outer housing 36 has a tubular body 38 defining a bore 39 for reception of the inner housing 37 and through passage of the pump housing 9. A lower end 40 of the housing 38 has a stepped central through hole 41, an inner portion 42 of which receives an O-ring seal 43. An outwardly extending flange 44 at an upper end of the housing 38 has an upstanding peripheral rim 45. A number of spaced-apart through holes 46 are provided in the flange 44. A retaining ridge 47 is provided on an inner side wall of the rim 45 for retention of the inner housing 37 within the outer housing 36. The inner housing 37 has a tubular body 48 defining a bore 49 for reception of the pump housing 9. A flanged upper end 50 of the inner housing 37 has a number of through holes 51 associated with the holes 46 in the outer housing 36. The inner housing 37 is engagable within the outer housing 36 to securely engage an annular filter ring 52 between the flanges 44, 50 of the housings 36, 37. A bottom wall of the inner housing has a central through hole 53. FIG. 10 shows the filter assembly 35 mounted within a neck 54 of the container 2. It will be noted that an outer surface 55 of the rim 45 of the outer housing 36 sealingly engages an inner surface of the neck 54. The filter assembly 35 is a push fit into engagement with the neck 54 of the container 2. The pump 3 is mounted on the container 2 with the pump housing 9 passing downwardly through the inner housing 37 and projecting through the holes 41, 53 with an airtight seal being made with the pump housing 9 at the bottom of the housings 36, 37 by the O-ring seal 43. Vent air is thus obliged to pass through the filter ring 52 into the container 2.

Referring now to FIGS. 11 to 14, there is shown another filter assembly 160 for an atomiser of the type previously described. In this case, the filter assembly 160 comprises a pair of filter support plates, namely, an upper filter support plate 161 and a lower filter support plate 162. The upper plate 161 has a central through hole 163 with a number of radial slots 164. These slots 164 align with associated through holes 165 in the lower plate 162. The lower plate 162 has a central through hole 166. An annular filter sheet 167 is mounted between the plates 161, 162. A filter plate support 168 is mounted in the neck 54 of a container 2 as previously shown in FIG. 10, a tubular body 169 of the support 168 sealingly engaging within the neck 54. The filter plates 161, 162 are received within a bore 170 of the support 168. The pump housing 9 passes down through the filter plates 161, 162. FIG. 14 shows the filter plates 161, 162 which can be integrally moulded of plastics material with an interconnecting integral hinge 172.

Referring now to FIGS. 15 and 16 there is illustrated portion of another water atomiser 60 largely similar to the water atomiser of FIGS. 1 to 5 and like parts are assigned the same reference numerals. In this case the atomiser 60 has a filter holder 61 in the form of an annular ring having a central bore 62 for sliding engagement with the pump housing 9. An O-ring 63 may optionally be provided within the bore 62 to ensure an air-tight seal between the holder 61 and the pump housing 9. A number of spaced-apart through holes 64 are provided around the holder 61 in similar fashion to the previously described holders. An annular filter sheet 65 is mounted on the holder 61 across the holes 64. On an upper surface of the holder 61 an upwardly protecting ring 67 is provided adjacent a periphery of the holder 61, the ring forming an energy director for ultrasonically welding the holder 61 to an underside of the flange 14 of the pump 3.

Referring now to FIGS. 17 and 18 there is illustrated portion of another atomiser 70 which is largely similar to the atomiser of FIGS. 1 to 5 and like parts are assigned the same reference numerals. In this case a filter assembly 71 is provided having a holder with a tubular body 72 engagable with an upper end of the pump housing 9. An upper end wall 73 of the body 72 has a central through hole 74 for through passage of the pump plunger 5. An air-tight seal is provided by an O-ring 76 mounted between an inner face of the end wall 74 and the plunger 5. A spacer washer 77 is mounted between an underside of the O-ring 76 and the upper end 78 of the pump housing 9. This spacer washer 77 has a radial slot 79 which extends outwardly of the O-ring 76 to allow vent air to pass under the O-ring 76 and down through a vent passage formed between an exterior of the pump plunger 5 and the associated bore in the pump housing 9 within which the plunger 5 is mounted. An annular filter sheet 80 is mounted on the end wall 73 covering a number of vent holes 81 passing through the end wall 73.

In use, the atomiser 70 is used in similar fashion to the atomiser of FIGS. 1 to 5. As an air-tight seal is formed between the body 72 of the filter holder and pump housing 9 and plunger 5, vent air must travel through the filter sheet 80, under the O-ring seal 76 and downwardly along the plunger exterior into the container. It will be appreciated that the filter assembly 71 can be readily easily fitted on the atomiser 70 and may either be provided with the atomiser or as a separate unit for fitting on atomisers of this type.

Referring now to FIGS. 19 to 21 there is illustrated another atomiser 90 again largely similar to the atomiser of FIGS. 1 to 5 and like parts are assigned the same reference numerals. In this case the atomiser 90 has a filter assembly 91 having a filter holder with a tubular body 92 which loosely engages around an upper end 93 of the pump housing 9. An upper end wall 94 of the body 92 has a central through hole 95 for through passage of the pump plunger 5. An O-ring seal 96 is provided at the hole 95 to give an air-tight seal between the end wall 94 and the plunger 5. An outwardly extending flange 97 on the body 92 is a snap-fit in engagement with the outer edge 15 of the pump mounting flange 14. A filter sheet 98 is supported on the flange 97 across vent holes 99 in the flange 97.

The atomiser 90 is used in similar fashion to the previously described atomisers, vent air passing through the filter sheet 98 up between the body 92 of the holder and the pump housing 9 passing between the plunger 5 and its associated bore in the pump housing 9 for exit into the container 2.

Referring now to FIGS. 22 and 23 there is illustrated another atomiser 100 generally similar to the atomiser of FIGS. 1 to 5 and like parts are assigned the same reference numerals. In this case the vent passage is formed by a vent pipe 101 passing through the mounting flange 14 of the pump housing 9. A filter holder 102 is mounted at an outer end of the vent pipe 101 supporting a filter sheet 103 mounted across an inlet end 104 of the vent pipe 101. The filter sheet 103 is retained behind a protective cover 105 having through holes 106 for free flow of air through the cover 105. The atomiser 100 is operated in similar fashion to the previously described atomisers.

Referring now to FIGS. 24 and 25 there is illustrated a carrier 260 for a water atomiser of the type previously described. The carrier 260 has a housing 261 for reception of a water atomiser 1. When mounted within the housing 261 the discharge opening 11 of the nozzle 10 of the atomiser 1 aligns with an outlet opening 263 in a front wall of the housing 261. An operating button 264 mounted on a top of the housing 261 is operable to move the nozzle 10 and hence the pump plunger to discharge a fine spray of water from the atomiser 1. FIG. 25 shows a rear wall 265 of the housing 261 which has a pair of spaced-apart inverted keyhole-shaped slots 266 for engagement with screw heads to demountably secure the housing 261 on a support surface such as a wall or the like.

It will be appreciated that the carrier 60 may also be used for other types of water atomiser in addition to the ones described herein.

Referring now to FIGS. 26 to 30, there is shown another atomiser carrier device 120. The device 120 has a housing 121 within which an atomiser 1 is mounted. The atomiser 1 is mounted on a support 124 having a frame 125 for reception of an atomiser 1. The frame 125 is supported on a pivot link 126 having inclined pivot arms 127 at each side of the frame 125 lower ends of each pivot arm being pivotally mounted on the housing 121. An operating button 129 engages the frame 125 through link arms 130. A U-shaped guide 131 is provided within which the button 129 is slidable. Upon moving the button 129 inwardly in the direction of arrow X (FIG. 30) the arms 127, 130 move the frame 125 upwardly to engage the nozzle head 10 against a stop 135 thus delivering an atomised spray of water on demand from the device 120. A return spring 136 connects between a lower end of the frame 125 and the housing to return the frame 125 to the lowered position when the button 129 is released.

Referring to FIGS. 31 to 34, another dispenser device 140 is shown. The device 140 has a housing 141 within which is mounted a bottle holder 142. As can be seen in FIG. 32, the atomiser 1 is housed within the bottle holder 142 with the nozzle portion 10 resting against a stop 143 at a top of the bottle holder 142. A bottle raising cam 145 is pivotally mounted on a base 146 of the bottle holder 142 by means of a pivot pin 147. Downwardly depending flanges 149 at a bottom of the bottle holder 142 slidably receive an operating button 150 for actuation of the cam 145. Slots 151 on the button 150 slidably engage the flanges 149. Upon depressing the button 150, the cam 145 pivots to raise the bottle within the bottle holder 142 thus operating the nozzle 10 to discharge a fine atomised mist of water.

Referring now to FIGS. 35 and 36, there is illustrated another carrier 180 comprising a housing 181 within which an atomiser 1 is mounted. The nozzle 10 of the atomiser 1 is aligned with an outlet hole 183 on the housing 181. An operating button 184 is operable to pivot an actuating cam 186 by means of a drive motor acting through a gear train 187 to operate the nozzle 10 for discharge of an atomised spray of water from the atomiser 1.

The invention is not limited to the embodiments hereinbefore described which may be varied in both construction and detail.

We claim:

1. A carrier for a pump type atomiser including a bottle with a pump having a spring loaded plunger at a top of the bottle for dispensing liquid from the bottle through a nozzle having a discharge opening mounted on the plunger, the carrier comprising:

a housing for reception of the atomiser, the housing having mounting means for mounting the carrier on a support surface, a bottle holder mounted within the carrier for reception of the atomiser bottle, the bottle holder having means for supporting the bottle in an upright position within the housing, the housing having an outlet opening associated with the nozzle discharge opening, the bottle holder adapted to support the bottle within the housing with said openings in alignment, the bottle holder having a top and a base, a stop being provided at the top of the bottle holder for engagement with the nozzle, a bottle raising cam pivotally mounted at the base of the bottle holder for engagement with a bottom face of the bottle, the bottle holder having downwardly depending flanges at the base of the bottle holder, a cam operating button slidably engagable with said flanges for actuation of the cam to raise the bottle within the bottle holder for pressing the nozzle against the stop to discharge liquid from the bottle through the nozzle in an atomised mist.

* * * * *